US006553906B1

(12) United States Patent
Bucks et al.

(10) Patent No.: US 6,553,906 B1
(45) Date of Patent: Apr. 29, 2003

(54) METHOD AND APPARATUS FOR SENSING A REGISTER DISCREPANCY IN A MULTI-COLOR PRINTED ITEM, AND REGISTER CONTROL SYSTEM AND REGISTER MARKS

(75) Inventors: Rodney R. Bucks, Webster, NY (US); Christopher B. Liston, Kiel (DE); Patrick Metzler, Gettorf (DE)

(73) Assignee: NexPress Solutions LLC, Rochester, NY (US)

( * ) Notice: Subject to any disclaimer, the term of this patent is extended or adjusted under 35 U.S.C. 154(b) by 24 days.

(21) Appl. No.: 09/690,508

(22) Filed: Oct. 17, 2000

(51) Int. Cl.[7] ..... B41M 1/14

(52) U.S. Cl. ..... 101/211; 101/485; 101/181; 250/559.44; 382/112; 382/165

(58) Field of Search ..... 101/485, 486, 101/180, 181, 216, 219, 228, 248, 178, 211, 481; 250/559.44, 226, 548, 547; 382/112, 165, 162

(56) References Cited

U.S. PATENT DOCUMENTS

| | | | | | |
|---|---|---|---|---|---|
| 4,003,660 | A | * | 1/1977 | Cristie, Jr. et al. | 250/226 |
| 4,165,465 | A | * | 8/1979 | Kanatani et al. | 101/181 |
| 4,528,630 | A | * | 7/1985 | Sargent | 101/181 |
| 4,534,288 | A | * | 8/1985 | Bowman | 101/211 |
| 4,546,700 | A | * | 10/1985 | Kishner et al. | 101/211 |
| 5,018,213 | A | * | 5/1991 | Sikes | 382/112 |
| 5,402,726 | A | * | 4/1995 | Zevien | 101/481 |
| 5,689,425 | A | * | 11/1997 | Sainio et al. | 101/181 |
| 5,992,318 | A | * | 11/1999 | Di Bello et al. | 250/559.44 |
| 6,065,400 | A | * | 5/2000 | Van Wenerberg | 101/211 |
| 6,129,015 | A | * | 10/2000 | Dewey | 101/211 |

FOREIGN PATENT DOCUMENTS

| | | | |
|---|---|---|---|
| DE | 27 31 914 | 1/1979 | B65H/25/24 |
| EP | 0 094 027 | 11/1983 | B41F/13/12 |

OTHER PUBLICATIONS

Offenlegungsschrift 27 31 914, dated Jan. 25, 1979.

* cited by examiner

*Primary Examiner*—Eugene H. Eickholt
(74) *Attorney, Agent, or Firm*—James D. Leimbach

(57) ABSTRACT

A method for sensing a register discrepancy (r) in a multi-color printed item, the position of at least one register mark (1, 1') that is associated with one color being sensed with respect to the position of at least one register mark (2, 2') that is associated with at least one further color, and any density register discrepancy (r) using a measurement window being ascertained from discrepancies in the actual relative position (3) with respect to the reference relative position (4). The invention, furthermore, concerns an apparatus, a register control system, and register marks (1, 1', 2, 2').

28 Claims, 4 Drawing Sheets

METHOD AND APPARATUS FOR SENSING A REGISTER DISCREPANCY IN A MULTI-COLOR PRINTED ITEM, AND REGISTER CONTROL SYSTEM AND REGISTER MARKS

FIELD OF THE INVENTION

A method for sensing a register discrepancy in a multi-color printed item, the position of at least one register mark that is associated with one color being sensed with respect to the position of at least one register mark that is associated with at least one further color, and any register discrepancy being ascertained from discrepancies in the actual relative position with respect to the reference relative position.

The invention furthermore concerns an apparatus for carrying out such a method, a register control system having such an apparatus, and register marks for carrying out the method.

BACKGROUND OF THE INVENTION

The purpose of sensing register discrepancies is to control multi-color printing presses, since the individual single-color images must be exactly superimposed on one another. This exact alignment is brought about by the fact that first register marks are printed with the first printed single-color image, and further register marks are printed along with the subsequent single-color images. By way of an optical scanning apparatus, the positions of the register marks printed first (viewed in the transport direction of the paper) are compared to the register marks printed subsequently. If a positional displacement occurs in the register marks that are to be compared, the phase position of the individual printing rollers or of their printed images is adjusted so that the register marks, and thus also the individual single-color images, are aligned relative to one another within the desired tolerance range.

A method of the kind cited initially, an apparatus for carrying it out, a register control system, and register marks for such a method are known from DE Unexamined Application No. 27 31 914. In this, a series of test marks with gaps are provided; some of them serve to identify the register sensing region within the overall printed item, and a gap between two test marks represents the actual register mark for sensing register. This requires, however, separate optical scanning apparatuses configured specially for sensing the register marks and their exact position, thus marking the presses more expensive and requiring valuable additional space.

SUMMARY OF THE INVENTION

It is, therefore, an object of the invention to eliminate the optical scanning apparatuses which serve exclusively for the sensing of register marks.

With regard to this method, the object is achieved in that the possible register discrepancy between colors, for which the sum of adjacent individual densities is not equal to the total density when the colors are superimposed, is ascertained by the fact that first the individual densities of the colors and their total density when printed onto one another is measured; then the density of the register marks is measured in a measurement window; and then, from the measured density values, the degree of overlap of the register marks in the measurement window, and from that the register discrepancy, is measured.

In terms of the apparatus for carrying out such a method, the object is achieved in that it has at least one densitometer and one analysis device, the at least one densitometer being provided for the sensing of individual densities of colors and of a total density of at least two colors printed onto one another, and for measuring the density of the register marks in at least one measurement window; and the analysis device being configured such that from the measured density values, it ascertains the degree of overlap of the register marks in the at least one measurement window and, from that, the register discrepancy.

There is proposed for the apparatus according to the present invention a register control system in which there is connected to the aforesaid analysis device a control device which is configured such that, in accordance with the register discrepancies, it issues positioning commands to positioning elements of the individual printing units in order to bring about the reference relative position of the various colors with respect to a reference color.

To carry out the method according to the present invention, register marks are proposed which are configured in planar fashion with defined boundaries for sensing of the density using a densitometer, the sum of adjacently located individual densities of various colors being unequal to the total density when the colors are superimposed, and the arrangement of the register marks being such that the total densities of register marks within a measurement window can be sensed by a densitometer.

BRIEF DESCRIPTION OF THE DRAWINGS

The principle of the invention, as well as exemplary embodiments thereof, are explained with reference to the drawings, in which.

DETAILED DESCRIPTION OF THE INVENTIONS

Figure 1:
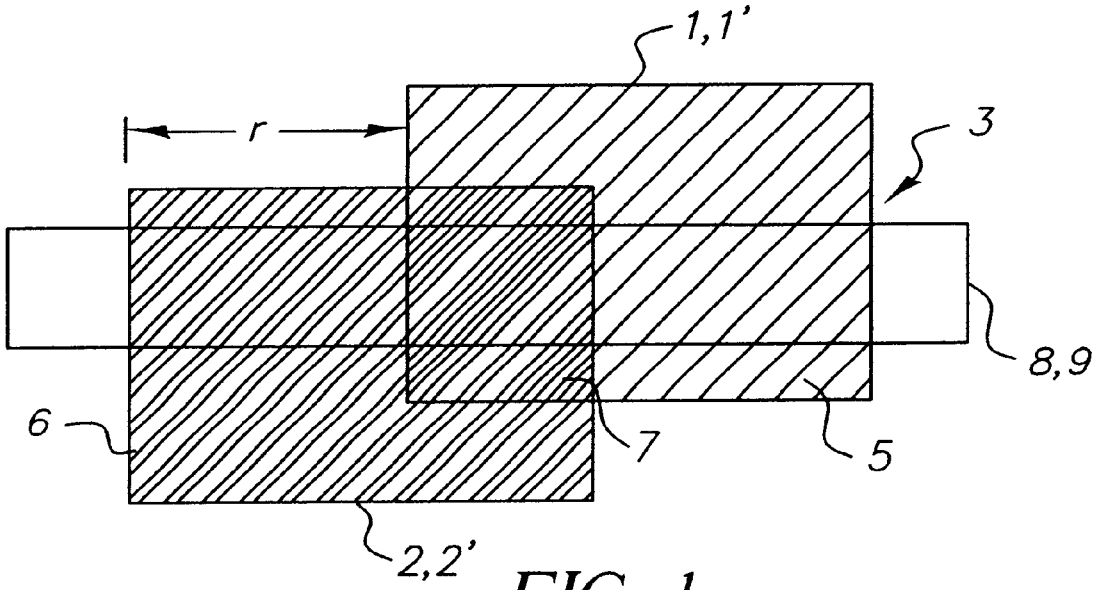
FIG. 1 shows a simple exemplary embodiment to explain the principle according to the present invention.

The basic idea of the invention is to use the densitometer, present in any case on a multi-color printing press to check the density of the printed colors, also to sense register discrepancies. According to the present invention, the method, the apparatus, and the register marks serve to achieve this kind of multifunctionality in a densitometer. The proposed register control system provides concrete implementation in the printing press in order to achieve the initially cited purpose which underlies the sensing of register discrepancies, namely to control the phase position of the printing rollers or printed images in a multi-color printing press.

The condition that the sum of adjacently located individual densities of colors is unequal to the total density when the colors are superimposed results from the fact that the densitometric measurement can be utilized to ascertain the register discrepancy only if the density measured in a measurement window changes as a function of the degree of overlap of the register marks of the colors, the position of a color advantageously always being ascertained with respect to a reference color. With the primary colors of multi-color printing, namely magenta, cyan, yellow, and black, such a change in density as a function of degree of overlap always occurs. It is only with special inks that this may, exceptionally, not be the case. In this situation, however, this condition can be created by selecting a different color as the reference color.

The ways proposed for achieving the objects of the invention, and their developments, are independent of the nature of the multicolor printed item and independent of the surface finish of the printed stock. Utilization is, thus, possible in electrostatic printing methods, for example, in color copiers in which the phase position of the printed images is regulated. The invention can, however, also be used, for example, in offset printing or in gravure printing, in which case the phase position of the printing roller must be adjusted. Utilization is also independent of whether the printing press is of the web or sheet-fed type.

Further developments of the invention, as well as embodiments and developments of the apparatus, register control system, and register marks, will be explained below. The method is advantageously configured such that the register discrepancies of all the colors are ascertained with respect to a common reference, preferably to a reference color. In this fashion the register discrepancy of a color from the reference color is always sensed, and is then corrected. When this is performed for all the colors, the color printed item is then in register.

A development provides for multiple register marks to be provided for each color. This can serve, in a manner yet to be explained, to prevent misinterpretation of a measured density value. In the case of an arrangement spaced apart with respect to the paper travel direction, it is also possible thereby to ascertain skewing.

Associating the measured densities with a register discrepancy is made easier by the fact that the register marks of all the colors are identical, in terms of the portion to be sensed in the measurement window, in terms of shape, arrangement, and size. Provision can be made in this context for the register marks to be multiple stripes which run transversely to the possible register discrepancy that is to be determined and which have identical widths. If the spacings between the stripes are identical, and if these spacings have the same dimension as the widths, this allows easy calculation of the register discrepancy. This calculation can be performed using the following formula:

$$r = k \times (-2 \times densi + dc) \times \frac{step}{(dC - dB - dM)}$$

in which:

r=Register discrepancy k=Conversion factor between the density difference between reference relative position and actual relative position, and the longitudinal dimension of the register discrepancy densi=Measured density dC=Common density dB=Density of a first color dM=Density of a second color step=Step width, corresponding in this case to the stripe width and the spacings between the stripes In order to determine the direction of a register discrepancy, i.e., to determine whether the color in question is located in front of or behind the first color, provision can be made for at least two measurements to be made, the register being shifted between the two measurements so as then to utilize different measured values in order to ascertain the register discrepancy. The same can, however, also be achieved by the fact that multiple arrangements of register marks are sensed. The functional principle of the precise determination of the register discrepancy is explained below with reference to the drawings. Multiple arrangements of register marks can also provide coarse and fine recognition. This is presented below in concrete terms.

If the register marks are not adapted to the measurement window, the result can be that a change in the positional allocation of the measurement window to the register marks that are to be sensed causes a change in the measured density. An error source of this kind can be avoided, for example, by the fact that the size of the measurement widows and of the register marks is selected such that the latter lie completely in the measurement windows. When the register marks comprising multiple stripes are used, this can be prevented by the fact that the stripes of the register marks are of such narrow configuration, in comparison with the length of the measurement window, that errors resulting from mutual positional shifts are negligible.

Even with large register discrepancies, it may happen that the measured density no longer yields a directly unequivocal association with the register discrepancy. A certain overlap of the register marks must always occur in order for the measured density to be associated with the position. With stripe-shaped register marks, moreover, it is necessary for the corresponding stripes of the register mark of the reference color to overlap partially the corresponding stripes of the register mark of the color whose position is to be sensed. For example, if the second or third stripe of one register mark lies on the first stripe of the other register mark, such an association is again no longer possible. To avoid this, either the register marks must be of a certain size (or the stripes must have a certain width), or a two-state procedure with coarse sensing and fine sensing must be selected. For two-stage sensing of this kind, it is proposed that the register marks used for coarse sensing be ones whose widths and spacings are substantially greater than the expected register error; and that after a correction of the register discrepancy that can be determined by the coarse sensing, the register marks sensed are ones whose selected widths and spacings are so small that the desired register accuracy can be attained.

In terms of the apparatus, to avoid a possible misinterpretation of measurement results it is proposed that the positioning elements be provided for relative displacement of the register of at least one color printing unit, the apparatus allowing a measurement before and after a relative displacement; and that the analysis device be configured such that, with the aid of the two measurements, it eliminates possible misinterpretations of the measurement results. Another possibility is that at least two densitometers are provided for simultaneous sensing of two register marks; and that the analysis device is configured such that with the aid of the at least two measurements, it eliminates possible misinterpretations of the measurement results.

In terms of the apparatus, it is proposed for the aforementioned coarse and fine sensing that positioning elements for relative displacement of the register serve to correct a register discrepancy that can be determined by way of the coarse sensing, and a fine sensing is accomplished thereafter by the fact that at least one densitometer senses finely divided register marks.

Skewing of a color by comparison with a reference line, for example, with respect to a reference line, can be sensed by the fact that at least two densitometers are arranged spaced apart transversely to the paper travel direction, and the analysis device is configured such that it utilizes the at least two measurements to ascertain any skewing of the printed result of one or more printing units. The skewing is evident in this case from the fact that the measurements which are spaced apart transversely to the paper travel direction yield different degrees of register discrepancy. The difference is then the indication of the skewing with reference to the spacing between the two measurements.

The register control system with which the purpose according to the present invention is ultimately achieved can also be configured in various ways. For example, the control device can be configured such that it ascertains positioning movements necessary for an error correction and brings about the reference relative position by way of positioning commands.

To prevent register discrepancies from being located in a region in which the measurement results can no longer be unequivocally assigned, provision is made for the register control system to be configured such that the apparatus for sensing a register discrepancy first performs a coarse determination of the register discrepancy and causes a correction thereof by way of the control device and the positioning elements; and then a fine determination of the register discrepancy, with a fine correction, is accomplished.

Instead of functioning with determined (for example, calculated) positioning commands, the register control system can also be configured such that, in the event of a register discrepancy, it delivers positioning commands for correction purposes until the fact that the reference relative position has been reached is recorded by way of the at least one densitometer and the analysis device. This embodiment is also possible with coarse and fine determination. In this case the positioning commands are performed up to a certain register discrepancy based on the coarse sensing and then on the basis of the fine sensing.

Advantageous configurations and embodiments are also provided for the register marks for carrying out the method. Reference is made, in this context, to the description of the method. Of course, no limits are set on the embodiment of the register marks. Regularly arranged pattern dots or any other geometrical figures could also be provided.

It is noted that the features and advantages that have been disclosed with respect to the individual subject matters; the method, the apparatus, the register control system, and the register marks; can also, in each case, be transferred in corresponding fashion to the other subject matters and that any combinations of features of these subject matters are possible. Various methods and apparatuses of known register sensing systems and register control systems can also be implemented with the density-based register mark sensing system according to the present invention by making corresponding modifications.

Referring now to the accompanying drawings, FIG. 1 shows an embodiment to explain the principle according to the present invention. To sense a register discrepancy r in a multi-color printed item, a register mark 1 or 1' is allocated to a first color, which serves here as the reference color. A second register mark 2 or 2' is allocated to a second color, whose register discrepancy with respect to the reference color is to be checked and corrected if necessary. Register marks 1, 1' and 2, 2' are dimensioned such that, even in the event of a relatively large register discrepancy 4, a partial printing overlap still occurs. The first color has a density 5, and the second color has a density 6.

Overlapping printing of the colors results in a total density 7, which must be different from the sum of density 5 and density 6. The reason is that given a density 5 of, for example, 60%, a density 6 of, for example, 40%, and a density 7 of, for example, 100%, the value measured for window 8 or 9 would always be the same regardless of the degree of overlap. A constellation of this kind must, therefore, be avoided, for example, by selecting a different reference color.

A densitometer 13 or 13' (see FIG. 6) senses densities 5, 6, and 7 within a measurement window 8. If the aforesaid condition is met, the density measured in measurement window 8 or 9 changes, depending on how much or how little the colors overlap. The density measured in measurement window 8 is, thus, an indication of the superimposition of register marks 1 and 2 or 1' and 2'. Register discrepancy r is, thus, proportional to the change in the measured density. The latter can, thus, be utilized for an exact determination of register discrepancy r.

Figure 2:
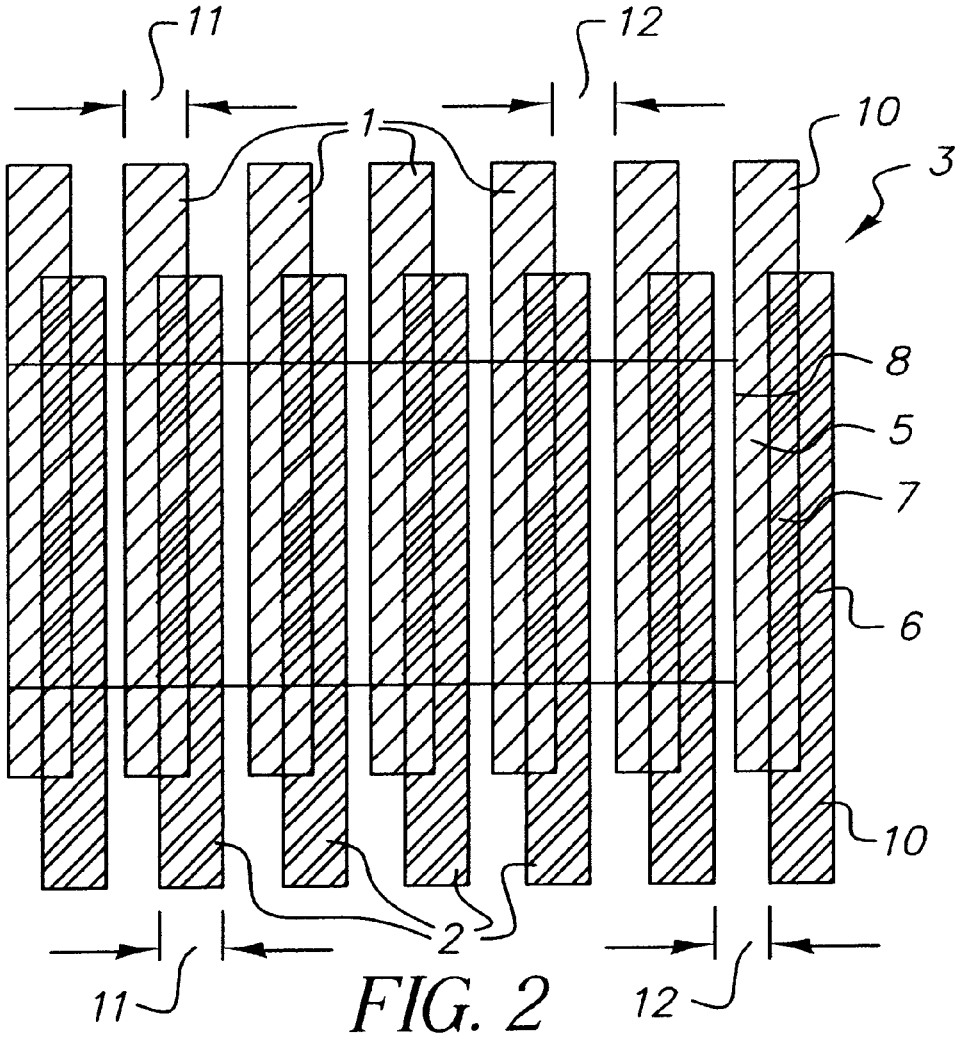
FIG. 2 shows an embodiment for more accurate sensing of a register discrepancy.

FIG. 2 shows an embodiment for more accurate sensing of a register discrepancy r. For this, register marks 1 and 2 are configured as stripes 10, widths 11 of stripes 10 and spacings 12 of stripes 10 having the same dimensions. Register marks 1 and 2 are of identical configuration. Here again, the density within a measurement window 8 is sensed by way of a densitometer 13 or 13'. In an actual relative position 3 (which deviates from the reference relative position), register marks 1 and 2 are not printed completely on top of one another but, instead, have a partial overlap. Register marks 1 and 2 are, thus, printed with an offset from one another equal to a register discrepancy r. By measuring the density within measurement window 8 and assuming a knowledge of total density 7 and of individual densities 5 and 6, register discrepancy r can be determined. With regard to the determination of this register discrepancy r, reference is made to the formula already shown above.

Figure 3:
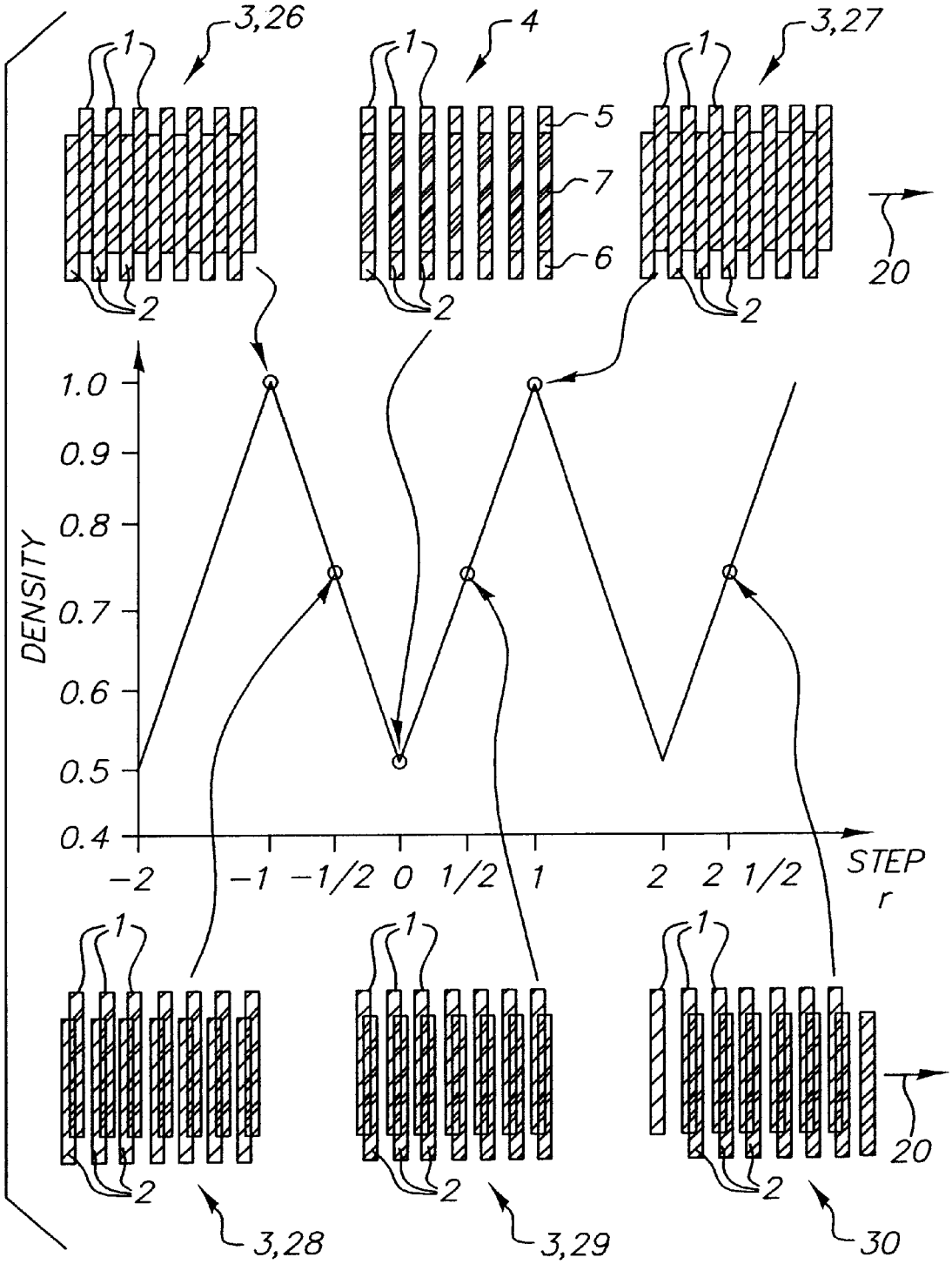
FIG. 3 shows a diagram with the measured density as a function of register discrepancy.

FIG. 3 shows a diagram with the measured density as a function of the register discrepancy. The register discrepancy was indicated not as a longitudinal dimension, but rather as a step width (step), this step width (step) corresponding to stripe width 11 and, thus, also to spacings 12 between stripes 10. The measured density (densi) is indicated here as an example, using the assumption that both colors have a density 5 and 6, respectively, of 100%. As a result, of course, total density 7 is also 100%. Register discrepancy r is zero when register marks 1 and 2 are printed exactly on top of one another. In this case, a density of 50% is measured inside a measurement window 8 or 9 (not depicted here), since 50% of the area of measurement window 8 or 9 is covered with color having a density of 100%. This reference relative position 4 is depicted at top center, and an arrow shows the point in the diagram corresponding to this situation.

The diagram further shows that actual relative position 3 can be determined in this fashion only within a certain range. For example, the density increases from 50% to 100%, within one step toward minus or toward plus, since, if register marks 1 and 2 are offset by one step, they fit between one another with no overlap, and, thus, a 100% density is measured in measurement window 8 by densitometer 13 or 13'. This is the case, both in a position 26 in which the second color is located one step behind the first color, and in a position 27 in which the second color is located one step in front the first color. These situations are illustrated at the top left and top right, and arrows, once again, indicate the points in the diagram corresponding to these situations 26 and 27. A register discrepancy r of one step, thus, results, in each case, in an increase or decrease in density from 50% to 100% and back from 100% to 50%. What this means is that an exact register discrepancy is possible only in a range in which the register discrepancy is definitely less than plus or minus one step. Identical measured values can occur even within this range, for example, position 28, that is illustrated, in which the second color is located half a step behind the first one and position 29 in which the second color is located half a step in front of the first one. A clearly defined allocation within this range is, however, possible by performing a slight displacement, for example, in the direction of paper travel 20. If the density decreases when such a displacement is made, then the second color is located in front of the first color, i.e., the register discrepancy went in the minus direction. If such a displacement causes the density to rise, then the second color is located behind the first color in paper travel direction 20, and what is present is a register discrepancy r in the plus direction. The same result can also be achieved by sensing two registers printed parallel and with a slight offset.

An allocation problem does occur, however, if register discrepancy r lies one step or more in the plus or minus direction.

This is illustrated by position 30 in which second color 2 is located 2½ steps in front of the first color. A solution to this problem is explained below.

Figure 4:
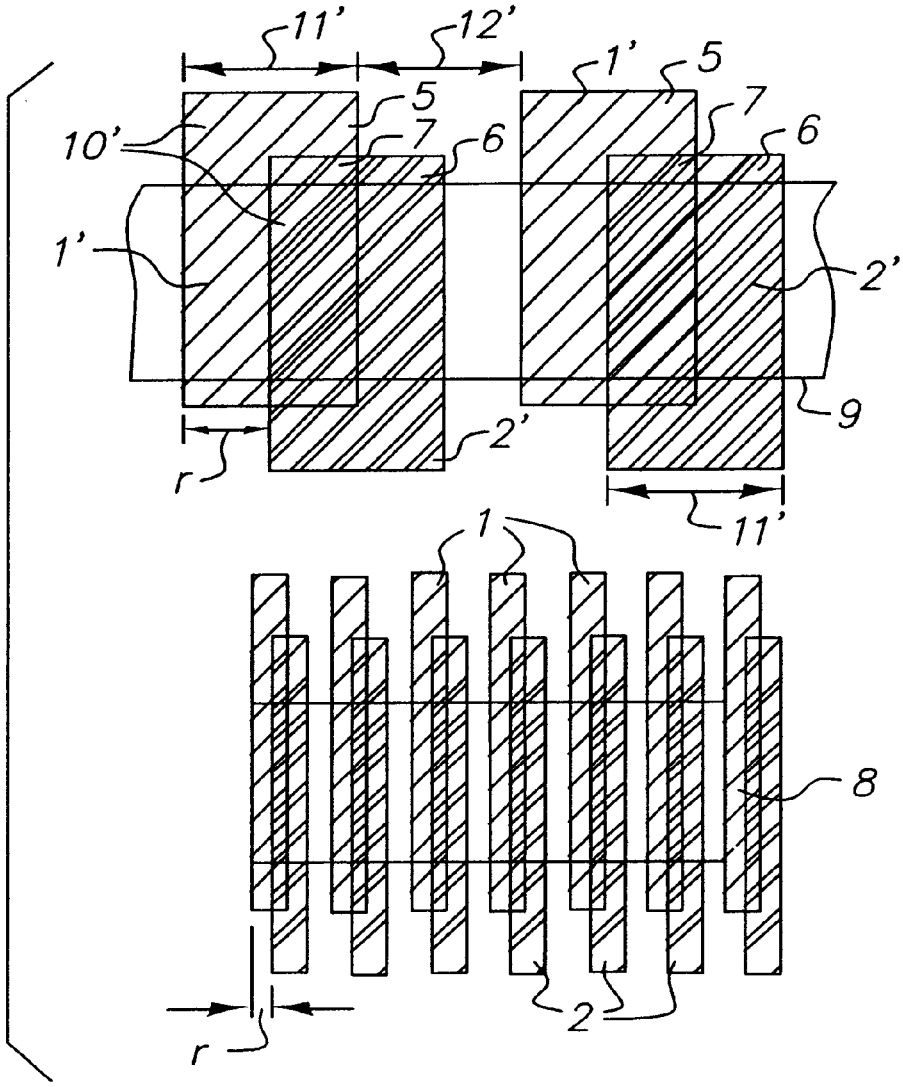
FIG. 4 shows an exemplary embodiment with coarse and fine sensing.

FIG. 4 shows an exemplary embodiment with coarse and fine sensing. Coarse sensing is provided by the same system as has just been described, the only difference being that register marks 1' and 2' are of a size such that register discrepancy r is definitely less than one step plus or minus. Corresponding to the enlarged register marks 1' and 2', the measurement window 9 must also be made larger, the "larger" referring to the extension in the direction in which register discrepancy r is to be determined. Only a portion of measurement window 9 is depicted. Its length should also be long by comparison with widths 11' and spacings 12' of stripes 10'. This applies both to the fine determination (described above) of register discrepancy r and to the coarse determination, since larger errors due to the relative position between register marks 1 and 2 or 1' and 2' printed onto one another, and measurement windows 8 or 9 can, thereby, be avoided.

Once a coarse correction has been made by sensing register marks 1' and 2', register discrepancy r has to also be reduced, for the fine determination, in such a way that it definitely lies in a range of plus or minus one step. A step for the fine determination is, of course, considerably smaller than for the coarse determination.

Figure 5:
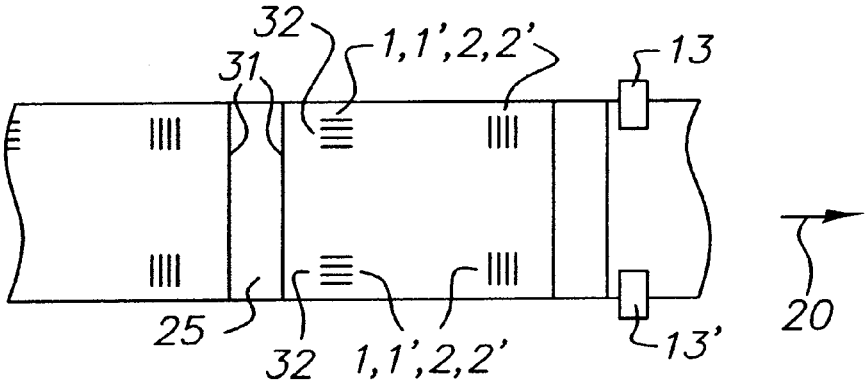
FIG. 5 shows an exemplary embodiment for sensing skewing.

FIG. 5 shows an exemplary embodiment for sensing skewing. For this purpose, register marks 1, 1', 2, 2' are arranged spaced apart transversely to paper travel direction 20. The arrangement is located, for example, on the outer edges, carrying register marks 1, 1', 2, 2', of sheets 31 of a printing stock that rests in immovably positioned fashion on the conveyor belt 25. Register marks 1, 1', 2, 2' could, however, also be printed onto conveyor belt 25 itself, if they are not wanted on sheet 31. Densitometers 13 and 13', which sense registers 1, 1', 2, 2', are then arranged in these edge regions. If register discrepancies r of the two sides are different, this means that a color has been printed in skewed fashion with respect to a reference line, for example, a reference color, and a corresponding correction is necessary. The depiction shows, in addition to a register mark that serves to determine a register discrepancy r in paper travel direction 20, a further register mark 32 that is provided for sensing a register discrepancy transversely to paper travel direction 20. An arrangement of this kind is, of course, also encompassed by the invention. Instead of sheet 31 of a printing stock, the context can also be that of a web-fed press, since the problem of keeping the various colors in register exists there as well, as does the need to align the various printing units.

Figure 6:
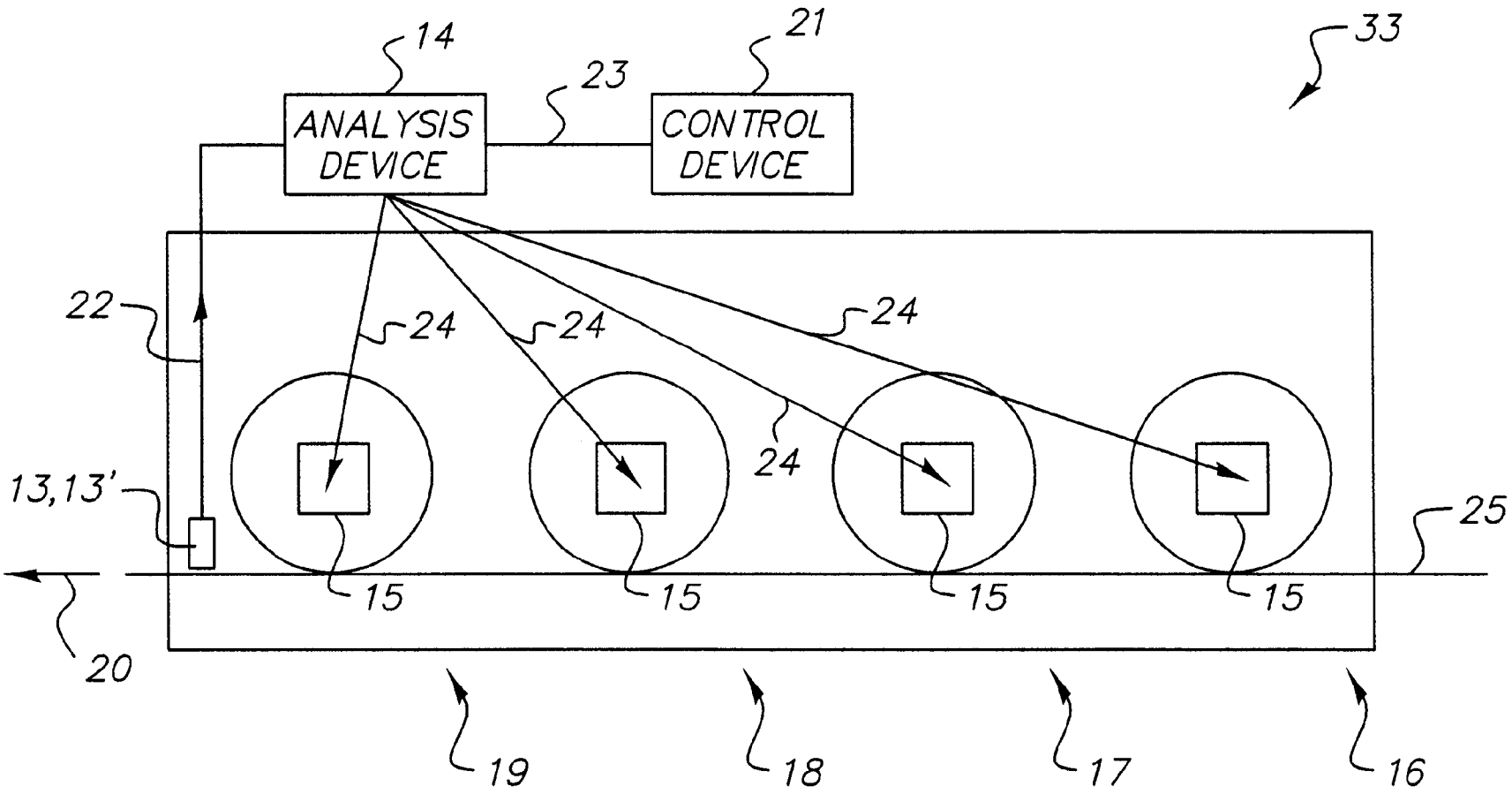
FIG. 6 shows a schematic depiction with a register control system.

FIG. 6 shows a schematic depiction of a printing press 33 having a register control system. Printing press 33 has four color printing units 16, 17, 18, and 19 for printing four colors. The printing stock is conveyed through printing press 33 by a conveyor belt 25, and each color printing unit 16, 17, 18, and 19 prints a single-color image onto the stock. Register marks 1, 1', 2, 2' are also printed in each case and are sensed by densitometers 13 or 13' in the manner described. In the case of a printed image comprising four colors, it is advantageous to print at least three pairs of register marks 1 and 2 or 1' and 2', since, as a result, one color is printed as the reference color, and the other three colors can be corrected in terms of their register with the reference color.

Once the corresponding measured values have been sensed by densitometers 13 and 13" they are sent via a connection 22 to an analysis device 14 which ascertains register discrepancy r from the measured values and sends it via a connection 23 to a control device 21. Control device 21 generates positioning commands in accordance with register discrepancies r that have been determined and transmits then via connections 24 to positioning elements 15 that are located on the various color printing units 16, 17, 18 and 19. These positioning elements 15 regulate either the phase positions of the individual printing rollers or the phase positions of the printed images, depending on the particular type of printing press. Instead of a conveyor belt 25, a printing press can, of course, also contain deflection drums which pass the sheets on from one color printing unit to another. The register control system can be transferred to any type of printing press; the particular configurations must take particular details into account.

The invention has been described in detail with particular reference to certain preferred embodiment thereof, but it will be understood that variations and modifications can be effected within the spirit and scope of the invention.

Parts List

| | |
|---|---|
| 1 | Register mark of a first color (reference color) |
| 1' | Register mark of a first color for coarse sensing |
| 2 | Register mark of a second color |
| 2' | Register mark of a second color for coarse sensing |
| 3 | Actual relative position |
| 4 | Reference relative position |
| 5, 6 | Individual densities |
| 5 | Density of a first color |
| 6 | Density of a second color |
| 7 | Total density when the colors are superimposed |
| 8 | Measurement window, fine sensing |
| 9 | Measurement window, coarse sensing |
| 10, 10' | Stripes of register marks |
| 11, 11' | Widths of stripes |
| 12, 12' | Spacings of stripes |
| 13, 13' | Densitometers |
| 14 | analysis device |
| 15 | Positioning elements |
| 16 | Color printing unit (first color) |
| 17 | Color printing unit (second color) |

-continued

| Parts List | |
|---|---|
| 18 | Color printing unit (third color) |
| 19 | Color printing unit (fourth color) |
| 20 | Paper travel direction |
| 21 | Control device |
| 22 | Connection between densitometer and analysis device |
| 23 | Connection between analysis device and control device |
| 24 | Connection between control device and positioning elements |
| 25 | Conveyor belt for sheets in a printing stock |
| 26 | Position in the case of a register discrepancy in which the second color is located one step behind the first color |
| 27 | Position in the case of a register discrepancy in which the second color is located one step in front of the first color |
| 28 | Position in the case of a register discrepancy in which the second color is located 2½ step behind the first color |
| 29 | Position in which the second color is located 2½ step in front of the first color |
| 30 | Position in which the second color is located 2½ steps in front of the first color |
| 31 | Sheets of a printing stock |
| 32 | Register mark for sensing a register discrepancy transversely to the paper travel direction |
| 33 | Printing press |
| r | Register discrepancy |
| densi | Measured density |
| step | Step width, preferably corresponding to the stripe width and to the spacings between the stripes |

What is claimed is:

1. A method for sensing a register discrepancy (r) in a multi-color printed item, the position of at least one register mark (1, 1') that is associated with one color being sensed with respect to the position of at least one register mark (2, 2') that is associated with at least one further color, and any register discrepancy (r) being ascertained from discrepancies in the actual relative position (3) with respect to the reference relative position (4), comprising the steps of:

providing a system wherein possible register discrepancy between colors (r), for which the sum of adjacent individual densities (5, 6) is not equal to the total density (7) when the colors are superimposed, as ascertained by the fact that first the individual densities (5, 6) of the colors and their total density (7) when printed onto one another is measured;

measuring the density (5, 6, 7) of the register marks (1, 1', 2, 2') in a measurement window (8, 9); and determining a degree of overlap from the measured density values (5, 6, 7), of the register marks (1, 1', 2, 2') in the measurement window (8, 9), and using the degree of overlap to determine from that the register discrepancy (r), is measured.

2. The method for sensing a register discrepancy, as defined in claim 1, wherein step of determining further comprises determining the register discrepancies (r) of all colors are ascertained with respect to a reference color (1).

3. The method for sensing a register discrepancy, as defined in claim 2, wherein the providing step further comprises multiple register marks (1, 1', 2, 2') are provided for each color.

4. The method for sensing a register discrepancy, as defined in claim 3, wherein the providing step further comprises the register marks (1, 1', 2, 2') of all the colors are identical, in terms of the portion to be sensed in the measurement window (8, 9), in terms of shape, arrangement, and size.

5. The method for sensing a register discrepancy, as defined in claim 1, wherein the providing step further comprises the register marks (1, 1', 2, 2') being multiple stripes (10) which run transversely to the potential register discrepancy (r) that is to be determined and which have identical widths (11).

6. The method for sensing a register discrepancy, as defined in claim 5, wherein the providing step further comprises identical spacings (12) between the stripes (10), and the spacings (12) have the same dimension as the widths (11).

7. The method for sensing a register discrepancy, as defined in claim 6, wherein the determining step further comprises the degree of overlap (r) being calculated as follows:

$$r = k \times (-2 \times densi + dc) \times \frac{step}{(dC - dB - dM)}$$

in which:

k=Conversion factor between the density difference by reference relative position and actual relative position, and the longitudinal dimension of the register discrepancy densi=Measured density dC=Common density dB=Density of a first color dM=Density of a second color step=Step width, corresponding in this case to the stripe width and the spacings between the stripes.

8. The method for sensing a register discrepancy, as defined in claim 7, wherein the measuring step further comprises making at least two measurements, and the register being shifted between the two measurements so as then to utilize different measured values in order to ascertain the (r).

9. The method for sensing a register discrepancy, as defined in claim 8, wherein the measuring step further comprises making multiple arrangements of register marks (1, 1', 2, 2') are sensed.

10. The method for sensing a register discrepancy, as defined in claim 9, wherein the measuring step further comprises creating the measurement window having a respective size to the register marks such that the register marks (1, 1', 2, 2') lie completely in the measurement windows (8, 9).

11. The method for sensing a register discrepancy, as defined in claim 9, wherein the providing step further comprises the stripes (10) of the register marks (1, 1', 2, 2') are provided of such narrow configuration, in comparison with the length of the measurement window (8, 9), that errors resulting from mutual positional shifts are negligible.

12. The method for sensing a register discrepancy, as defined in claim 11, wherein:

the providing step further comprises the register marks (1', 2') used for coarse sensing are ones whose widths (11') and spacings (12') are substantially greater than the expected register error (r); and the determining step further comprises a correction of the register discrepancy (r) that can be determined by the coarse sensing, the measuring and determining steps the register marks (1, 2) sensed are ones whose selected widths (11) and spacings (12) are so small that the desired register accuracy can be attained.

13. An apparatus for carrying out a method, as defined in claim 1, wherein:

said apparatus includes at least one densitometer (13) and one analysis device (14), said at least one densitometer

(13) being provided for the sensing of individual densities of colors and of a total density (7) of at least two colors printed onto one another, and for measuring the density of the register marks (1, 1', 2, 2') in at least one measurement window (8, 9); and said analysis device (14) being configured such that from the measured density values (5, 6, 7), it ascertains the degree of overlap of the register marks (1, 1', 2, 2') in the at least one measurement window (8, 9) and, from that, the register discrepancy (r).

14. The apparatus as defined in claim 13, wherein:

positioning elements (15) are provided for relative displacement of the register of at least one color printing unit (16, 17, 18, 19), said apparatus allowing a measurement before and after a relative displacement; and said analysis device (14) is configured such that with the aid of the two measurements, it eliminates possible misinterpretations of the measurement results.

15. The apparatus as defined in claim 13, wherein:

at least two densitometers (13, 13') are provided for simultaneous sensing of two register marks (1, 1', 2, 2'); and said analysis device (14) is configured such that with the aid of the at least two measurements, possible misinterpretation of the measurement results is substantially eliminated.

16. The apparatus as defined in claim 15, wherein positioning elements (15) for relative displacement of the register serve to correct a register discrepancy (r) that can be determined by way of coarse sensing, and fine sensing is accomplished thereafter by the fact that at least one densitometer (13, 13') senses finely divided register marks (1, 2).

17. The apparatus as defined in claim 16, wherein at least two densitometers (13, 13') are arranged spaced apart transversely to the paper travel direction (20), and the analysis device (14) is configured such that it utilizes the at least two measurements to ascertain any skewing of the printed result of one or more printing units (16, 17, 18, 19).

18. A register control system having an apparatus as defined in claim 13, wherein said register control system includes a control device (21) connected to the analysis device (14) which is configured such that, in accordance with the register discrepancies (r), it issues positioning commands to positioning elements (15) of said individual printing units (16, 17, 18, 19) in order to bring about the reference relative position (4) of the various colors with respect to a reference color.

19. The register control system as defined in claim 18, wherein said control device (21) is configured such that it ascertains positioning movements necessary for an error correction, and brings about the reference relative position (4) by way of positioning commands.

20. The method for sensing a register discrepancy as defined in claim 1, wherein:

the providing step further comprises the register control system is configured such that the sensing a register discrepancy first performs a coarse determination of the register discrepancy (r) and causes a correction thereof by way of said control device (21) and said positioning elements (15); and then a fine determination of the register discrepancy (r), with a fine correction, is accomplished.

21. The method for sensing a register discrepancy as defined in claim 20, wherein said register control system is configured such that in the event of a register discrepancy it delivers positioning commands for correction purposes until the fact that the reference relative position (4) has been reached is recorded by way of the at least one densitometer (13, 13') and the analysis device (14).

22. The method for sensing a register discrepancy as defined in claim 1 wherein the providing step further comprises providing the register marks (1, 1', 2, 2') for carrying out the method are configured in planar fashion with defined boundaries for sensing of the density using a densitometer (13, 13'), the sum of adjacently located individual densities (5, 6) of various colors being unequal to the total density (7) when the colors are superimposed, and the arrangement of said register marks (1, 1', 2, 2') being such that the total densities (5, 6, 7) of register marks (1, 1', 2, 2') within a measurement window (8, 9) can be sensed by a densitometer (13, 13').

23. The method for sensing a register discrepancy as defined in claim 22, wherein the providing step provides multiple register marks (1, 1', 2, 2') for each color.

24. The method for sensing a register discrepancy as defined in claim 23 and further comprising the register marks (1, 1', 2, 2') of all the colors are identical, in terms of the portion to be sensed in the measurement window (8, 9), in terms of shape, arrangement, and size.

25. The method for sensing a register discrepancy as defined in claim 24 and further comprising the register marks are configured as a plurality of stripes (10) which run transversely to the possible register discrepancy (r) that is to be determined and which have identical widths (11, 11').

26. The method for sensing a register discrepancy as defined in claim 25 and further comprising register marks as defined in claim 25, wherein the spacings (12, 12') between the stripes (10) are substantially equal, and the spacings (12, 12') have equivalent dimensions as the widths (11, 11').

27. The method for sensing a register discrepancy as defined in claim 26, wherein said stripes (10) of said register marks (1, 1', 2, 2') are of such narrow configuration, in comparison with the length of the measurement window (8, 9), that errors resulting from mutual positional shifts are negligible.

28. The method for sensing a register discrepancy as defined in claim 27 further comprising the register marks (1', 2') provided for coarse sensing are ones whose widths (11') and spacings (12') are substantially greater than the expected register error (r); and the register marks (1, 2) provided for fine sensing are ones whose selected widths (11) and spacings (12) are so small that the desired register accuracy can be attained.

* * * * *